US009259916B1

(12) United States Patent
Piatt et al.

(10) Patent No.: US 9,259,916 B1
(45) Date of Patent: Feb. 16, 2016

(54) SERVICEABLE PRINTHEAD SEALING MECHANISM

(71) Applicants: Michael J. Piatt, Dayton, OH (US); Charles D. Rike, Lebanon, OH (US)

(72) Inventors: Michael J. Piatt, Dayton, OH (US); Charles D. Rike, Lebanon, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/520,414

(22) Filed: Oct. 22, 2014

(51) Int. Cl.

| | |
|---|---|
| ***B41J 2/165*** | (2006.01) |
| ***B41J 2/02*** | (2006.01) |
| ***B41J 2/03*** | (2006.01) |
| ***B41J 29/17*** | (2006.01) |

(52) U.S. Cl.
CPC .... *B41J 2/03* (2013.01); *B41J 2/02* (2013.01); *B41J 2/16505* (2013.01); *B41J 29/17* (2013.01)

(58) Field of Classification Search
CPC ..... B41J 2002/1853; B41J 2/1747
See application file for complete search history.

(56) References Cited

U.S. PATENT DOCUMENTS

| | | | | |
|---|---|---|---|---|
| 2,615,227 | A * | 10/1952 | Hornik | A44C 5/2071 24/303 |
| 6,247,781 | B1 * | 6/2001 | Blum | B41J 2/185 347/22 |
| 6,398,335 | B1 | 6/2002 | Benjamin | |

FOREIGN PATENT DOCUMENTS

| | | | | |
|---|---|---|---|---|
| EP | 0741040 | A2 * | 11/1996 | B41J 2/1714 |
| JP | 2007105704 | A * | 4/2007 | B05C 11/10 |

* cited by examiner

*Primary Examiner* — Shelby Fidler
(74) *Attorney, Agent, or Firm* — William R. Zimmerli

(57) ABSTRACT

A printhead includes a jetting module that forms drops, a catcher, and a deflection mechanism that deflects some of the drops toward the catcher. A moveable sealing mechanism has a first position in contact with the catcher and a second position removed from the catcher that permits drops to travel past the catcher. The moveable sealing mechanism includes a first portion that is fixed to the printhead and translates the sealing mechanism relative to the catcher, and a second portion that is removably fixed to the first portion and cooperates with the catcher to form a seal when the sealing mechanism is in the first position. A removal tool for use with the printhead includes a shaft, a magnet affixed to the shaft, and a spacer affixed to the shaft. The spacer includes a valley that is aligned with the at least one magnet.

8 Claims, 14 Drawing Sheets

SERVICEABLE PRINTHEAD SEALING MECHANISM

FIELD OF THE INVENTION

This invention relates generally to the field of digitally controlled liquid ejection systems, and in particular to continuous liquid ejection systems in which a liquid stream breaks into drops at least some of which are deflected.

BACKGROUND OF THE INVENTION

Inkjet printing is commonly used for printing on paper or other types of print media and is generally a non-contact application of an ink to the print media. Typically, one of two types of ink jetting mechanisms are used and are categorized by technology as either drop on demand inkjet (DOD) or continuous inkjet (CIJ). The first technology, "drop-on-demand" (DOD) inkjet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal inkjet (TIJ)."

The second technology commonly referred to as "continuous" inkjet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of print media used with these inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

For highest productivity of these inkjet printing systems, it is common for the printing systems to use print modules which include an array of printheads to span the desired print width of the print media, so that the print media can be printed in a single pass of the print media past the print module. With such arrays of printheads there is a need to be able to service the print module, by removing, servicing and replacing a printhead from the array of printheads or of removing, servicing, and replacing of a component of one of the printheads. When the printheads or printhead components are installed in the print module, there is often a need to accurately position the serviceable unit relative to other portions of the print module. In many printing systems, there are space constraints that can hinder the task of removing and reinstalling the serviceable unit.

There is, therefore, a need for an improved system and method for securing and locating the serviceable unit in a print module of a printing system.

SUMMARY OF THE INVENTION

According to one aspect of the invention, a printhead includes a jetting module that forms drops, a catcher, and a deflection mechanism that deflects some of the drops toward the catcher. A moveable sealing mechanism has a first position in contact with the catcher and a second position removed from the catcher that permits drops to travel past the catcher. The moveable sealing mechanism includes a first portion that that is fixed to the printhead and translates the sealing mechanism relative to the catcher, and a second portion that is removably fixed to the first portion and cooperates with the catcher to form a seal when the sealing mechanism is in the first position.

According to another aspect of the invention, a removal tool for use with the printhead includes a shaft, a magnet affixed to the shaft, and a spacer affixed to the shaft. The spacer includes a valley that is aligned with the at least one magnet.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
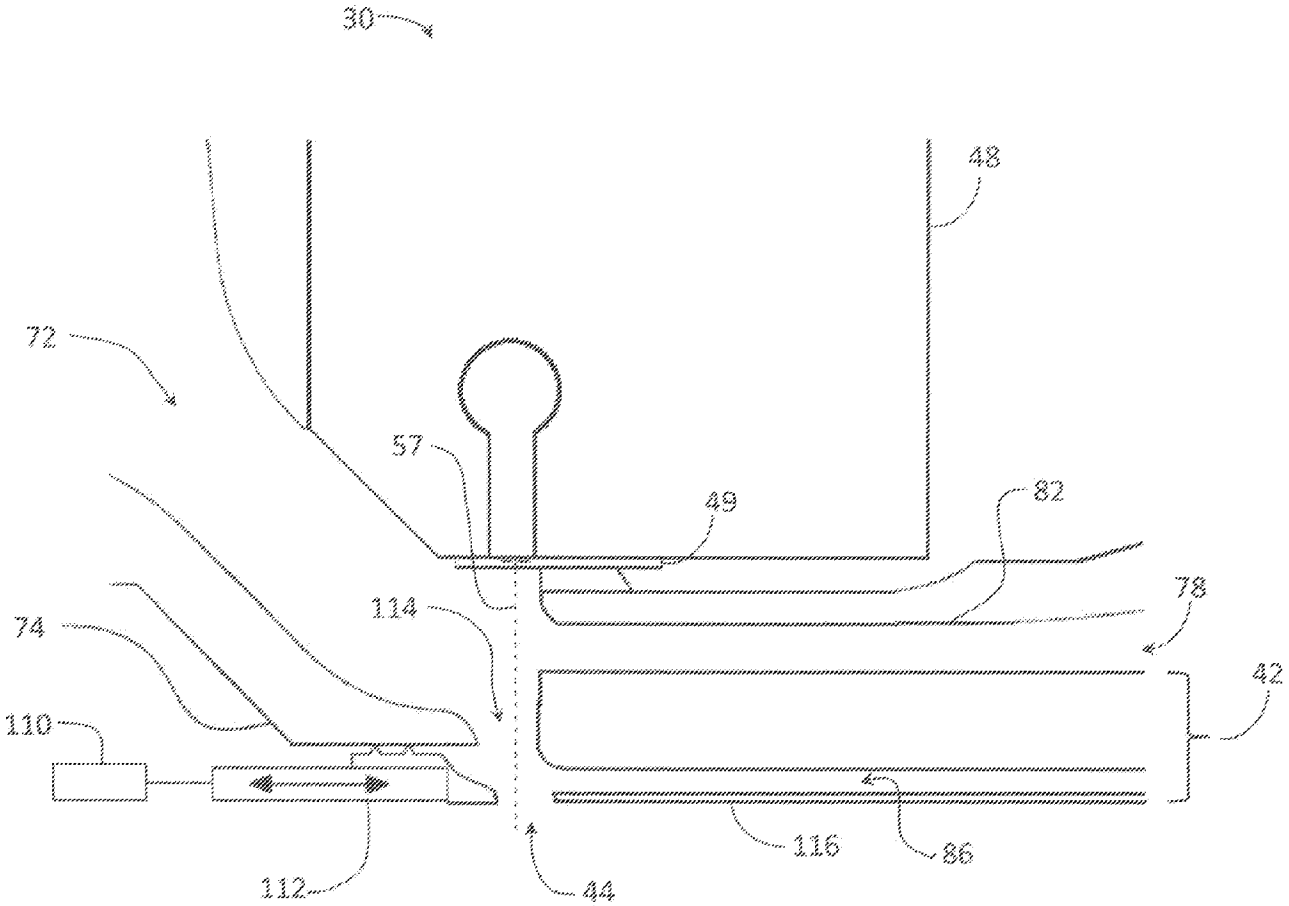
FIG. 1 is a schematic cross sectional view of an example embodiment of a printing system made in accordance with the present invention in showing a moveable sealing mechanism is located removed from a catcher.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

Throughout the specification, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the Figure(s) being described. Because components of embodiments of the present invention can be positioned in a number of different orientations, the directional terminology is used for purposes of illustration only and is in no way limiting.

As described herein, the example embodiments of the present invention can be used in printing systems, including inkjet printing systems that include a printhead or printhead components. Many applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper. However, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

FIG. 1 shows a schematic cross section of a portion of a continuous inkjet printhead 30. The printhead 30 includes a jetting module 48 on which a nozzle plate 49 is secured. Ink supplied under pressure to the jetting modules flows as liquid streams from the nozzles of the nozzle plate. The nozzle array extends into and out of the plane of FIG. 1. Conventional drop forming mechanisms (not shown) formed in the nozzle plate or secured to the jetting module cause the individual liquid streams to break up into streams of drops. In some printhead embodiments, the drop forming mechanism causes the liquid stream to break up into smaller drops and larger drops in response to input print data. An air flow across the array of drop trajectories interacts with the drops, causing the smaller drops to be deflected more than the larger drops so that the smaller drops follow a small drop trajectory and the larger drops follow a large drop trajectory. A catcher 42 is positioned to intercept one of the small drop trajectory and the large drop trajectory catching the intercepted drops while allowing the drops following the other trajectory to pass by the catcher and continue through the printhead outlet opening 44 to strike the print media. The air flow across the drop trajectories can be provided by one or both of a positive pressure air duct 72, which blows a flow of air across the drop trajectories, and a negative pressure air duct 78, which sucks a flow of air across the drop trajectories. A positive pressure air flow source, not shown, connected to the positive air flow duct 72 to provide a flow of blowing across the array of drop trajectories. A negative pressure source, not shown, attached to negative pressure air flow duct 78 to provide the suction to draw a flow of air across the array of drop trajectories.

Figure 2:
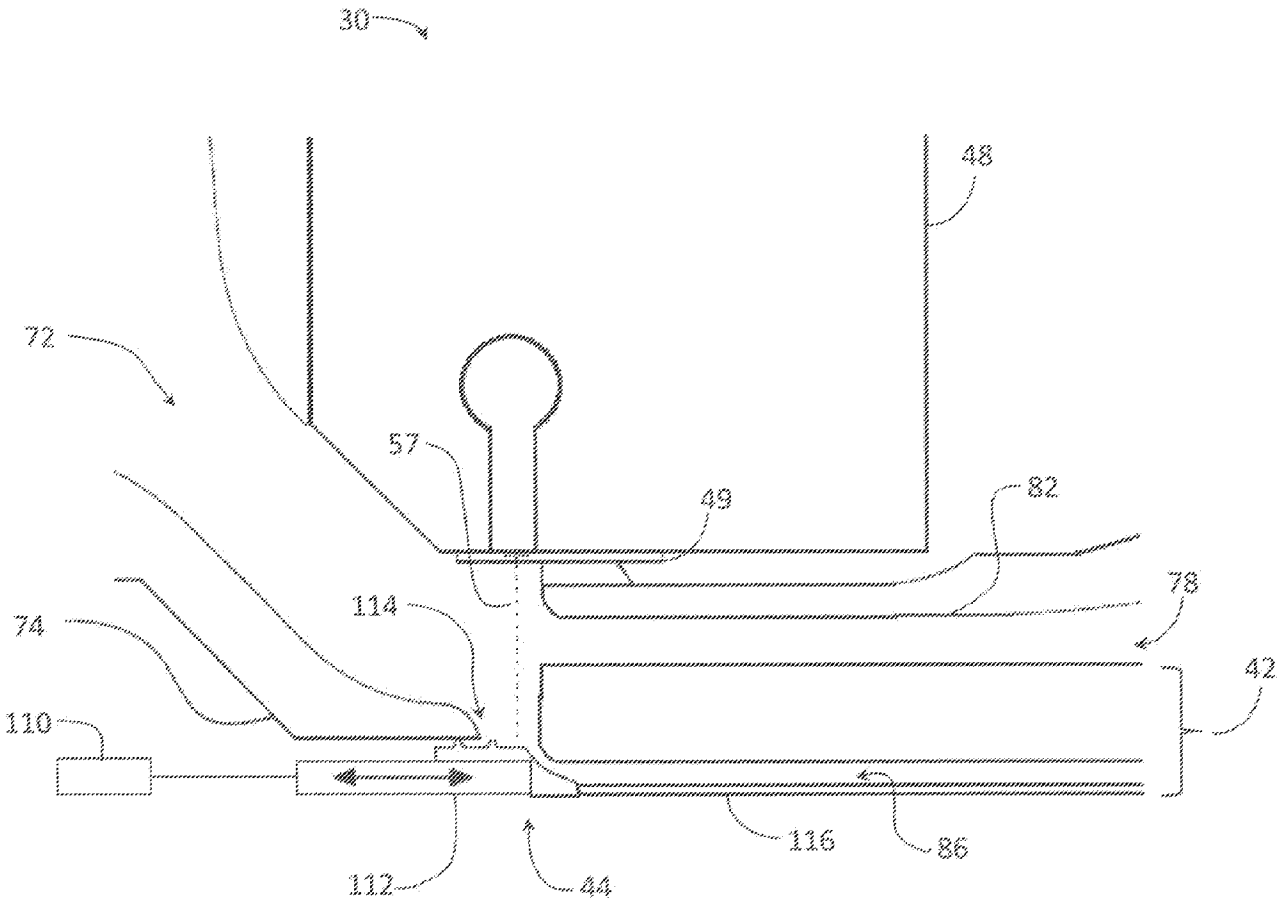
FIG. 2 is a schematic cross sectional view of the example embodiment shown in FIG. 1 with the sealing mechanism located in contact with the catcher.

During storage of the printhead and during maintenance operations, it has been common to seal off the outlet opening 44 with a movable sealing mechanism 112, as shown in FIG. 2. With the movable sealing mechanism 112 engaged against the bottom plate 116 of the catcher 42 through the action of actuator 110, the elastomeric portion 114 of the sealing mechanism 112 provides a seal against the against the bottom plate 116 of the catcher. It also seals against the lower wall 74 of the positive air flow duct 72. Ink from the drop streams 57 is diverted by the sealing mechanism 112 into the liquid return channel 86 of the catcher 42. The elastomeric portion 114 of the sealing mechanism seals against the bottom plate 116 of the catcher 42 and the lower wall 74 of the air duct 72, the movable sealing mechanism includes a removable elastomeric portion 114.

It has been found that there is a need to remove the movable sealing mechanism to service portions of the printhead. For example, it is necessary to remove the sealing mechanism 112 to enable the cleaning of lower portions of the positive air flow duct 72, the face of the catcher 42, the entrance region of the liquid return duct 86 of the catcher, the elastomeric portion of the sealing mechanism and the sealing edge of the catcher bottom plate 116 to remove ink residues or contaminants such as paper fibers. Removal of the sealing mechanism in the prior art system has involved removing the delicate springs (not shown) that provide the vertical force on the sealing mechanism 112 to seal against the lower wall 74 of the positive air flow duct 72. During the removal process or the reinstallation of the sealing mechanism, these springs can be easily damaged or distorted. Over time, the elastomeric portion 114 of the movable sealing mechanism can also be damaged or wear sufficiently that the elastomer needs to be replaced. Once the servicing activity is complete, the movable sealing mechanism must be reinstalled. To ensure effective sealing against the catcher bottom plate and the lower wall of the air duct, the reinstalled sealing mechanism must be properly aligned to these other printhead components. In particular it is necessary accurately align the vertical placement of the seal and the parallelism of the seal with the bottom plate of the catcher. Unfortunately, there is often minimal clearance for both the removal and the reinstallation of the sealing mechanism.

Figure 3:
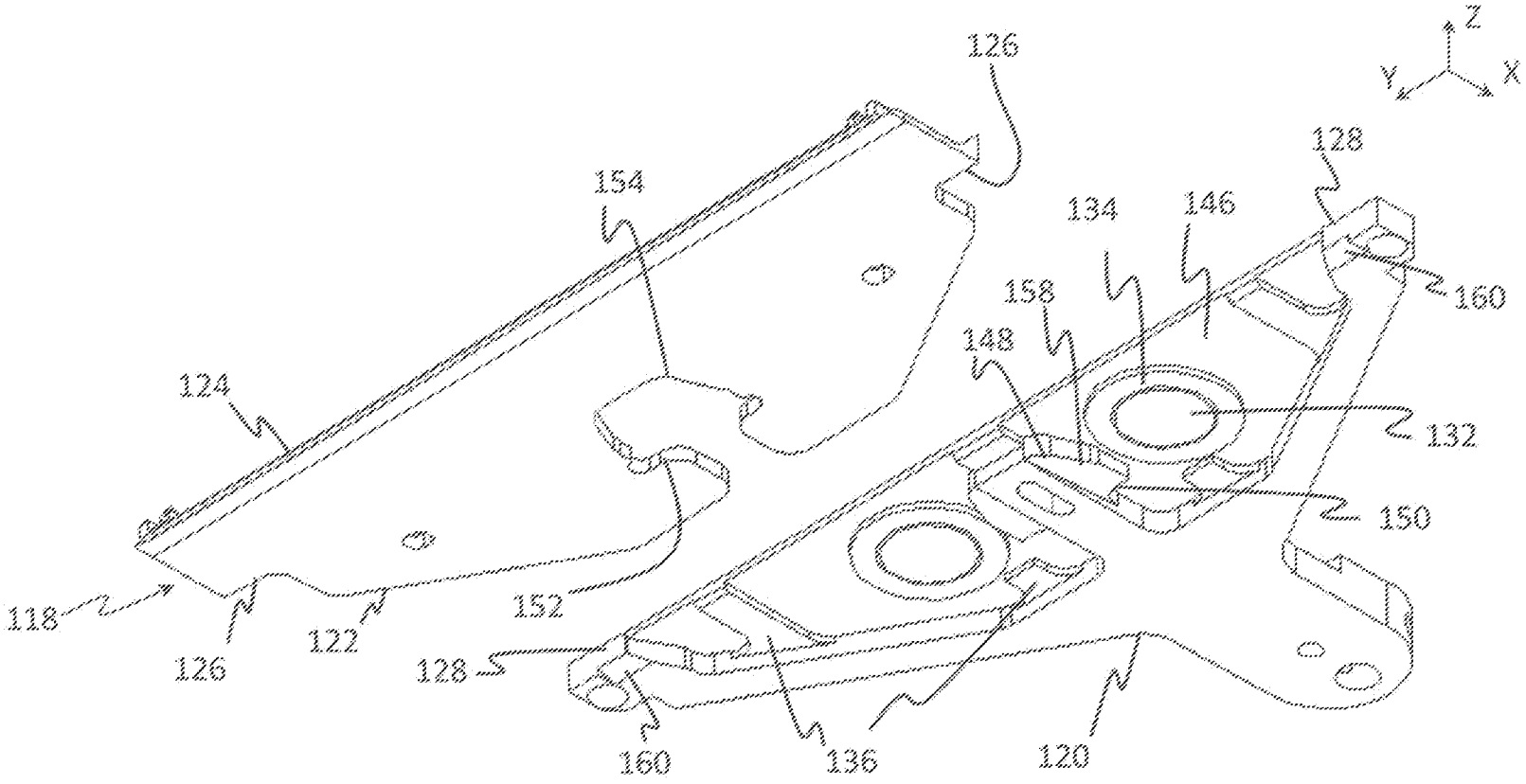
FIG. 3 is an exploded perspective view of an example embodiment of a sealing mechanism made in accordance with the present invention showing first and second portions of the sealing mechanism.
Figure 4:
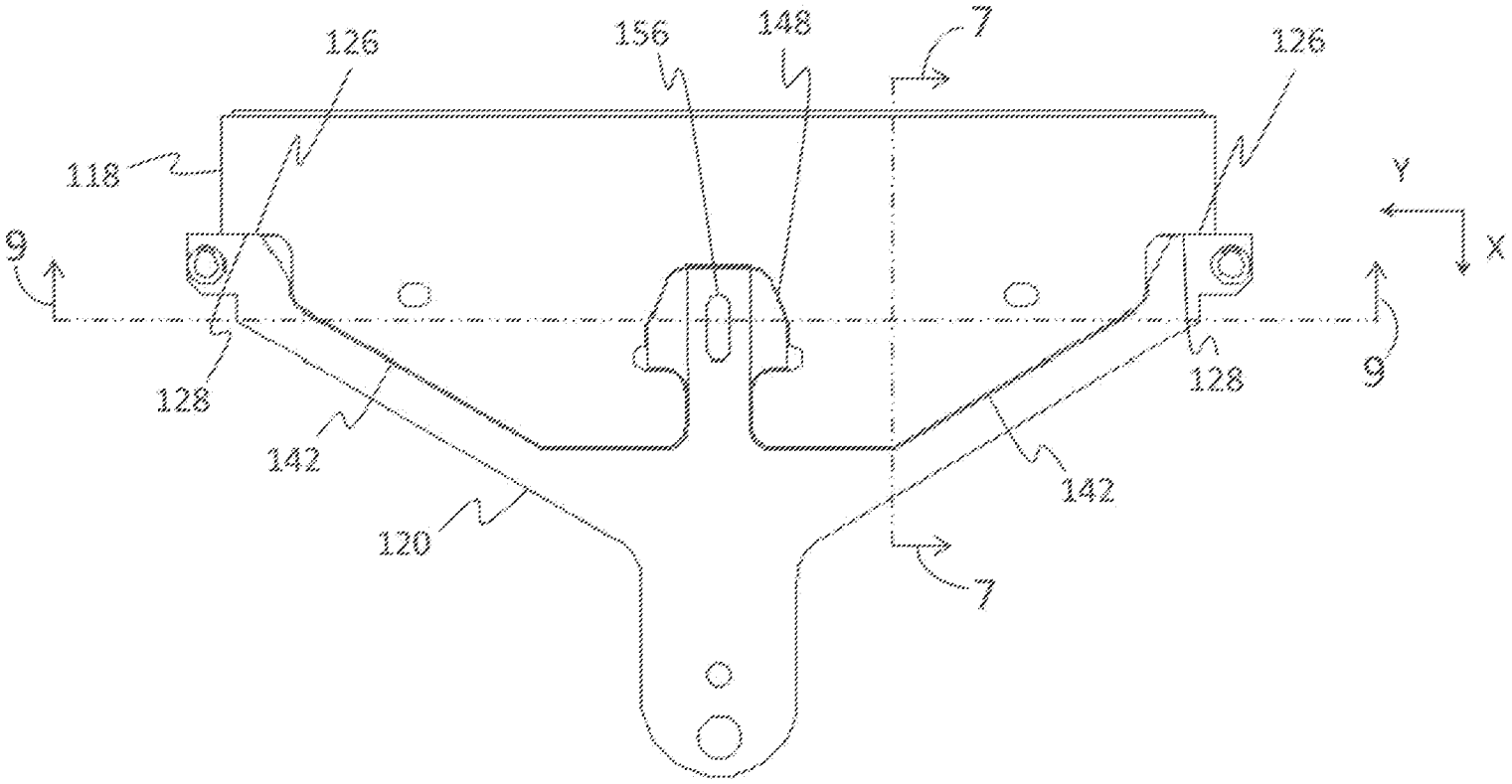
FIG. 4 is a bottom view of the sealing mechanism shown in FIG. 3.

To facilitate the removal and reinstallation of the seal of the movable sealing mechanism, moveable sealing mechanism 112 is made up of a first portion, commonly referred to as a non-removable portion, 120 and second portion, commonly referred to as a removable portion, 118, as shown in FIGS. 3 and 4. The removable portion 118 includes a stainless steel body 122 and an elastomeric seal 124. The elastomeric seal 124 is typically molded directly onto the stainless steel body 122, allowing its sealing surfaces to be positioned accurately relative to registration features, commonly referred to as locating features, 126 on the stainless steel body. The non-removable portion of the sealing mechanism includes registration features, commonly referred to as locating features, 128 that engage the locating features 126 of the stainless steel body 122 of the removable portion to enable the Z position of the removable portion 118 to be consistently defined relative to the non-removable portion 120 of the sealing mechanism. A clearance gap 142 is provided between the trailing edge of the removable portion 118 and the corresponding edge of the non-removable portion 120 of the sealing mechanism, to ensure that the locating features 126 and 128 engage with each other. With this two piece construction, it is only necessary to remove the removable portion of the moveable sealing mechanism to perform the typical maintenance operations. Following the maintenance operations, the removable portion can be easily reinstalled. The locating features of the two portions of the movable sealing mechanism enable the removable portion to accurately align itself with the non-removable portion without the need for expensive tooling when it is inserted into the bottom of the non-removable portion.

Figure 5:
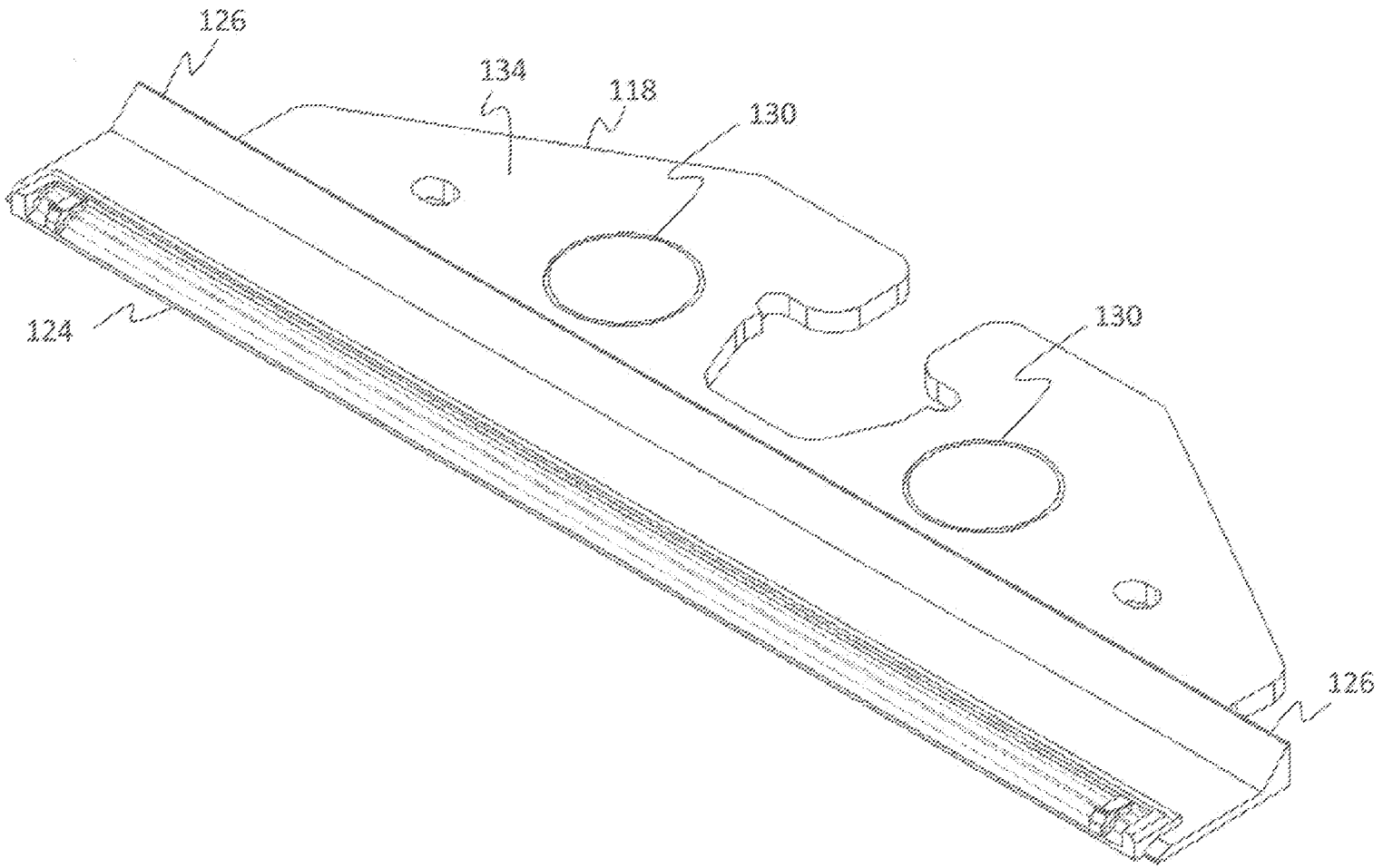
FIG. 5 is a perspective view of a removable (second) portion of the sealing mechanism.

The removable portion of the sealing mechanism is secured to the non-removable portion by means of magnets. Magnets 130 are bonded into pockets in the removable portion 118 and magnets 132 are bonded into the non-removable portions 120 of the movable sealing mechanism 112 as shown in FIGS. 3 and 5. The poling directions of the magnets on the two pieces are set so that the magnets 130 of the removable portion are attracted to the magnets 132 of the non-removable portion to hold the removable portion in place in the non-removable portion without the need for attachment screws or the like. The north pole of a magnet on the one part is adjacent to the south pole of the corresponding magnet of the other part, as shown in FIG. 6.

Figure 6:
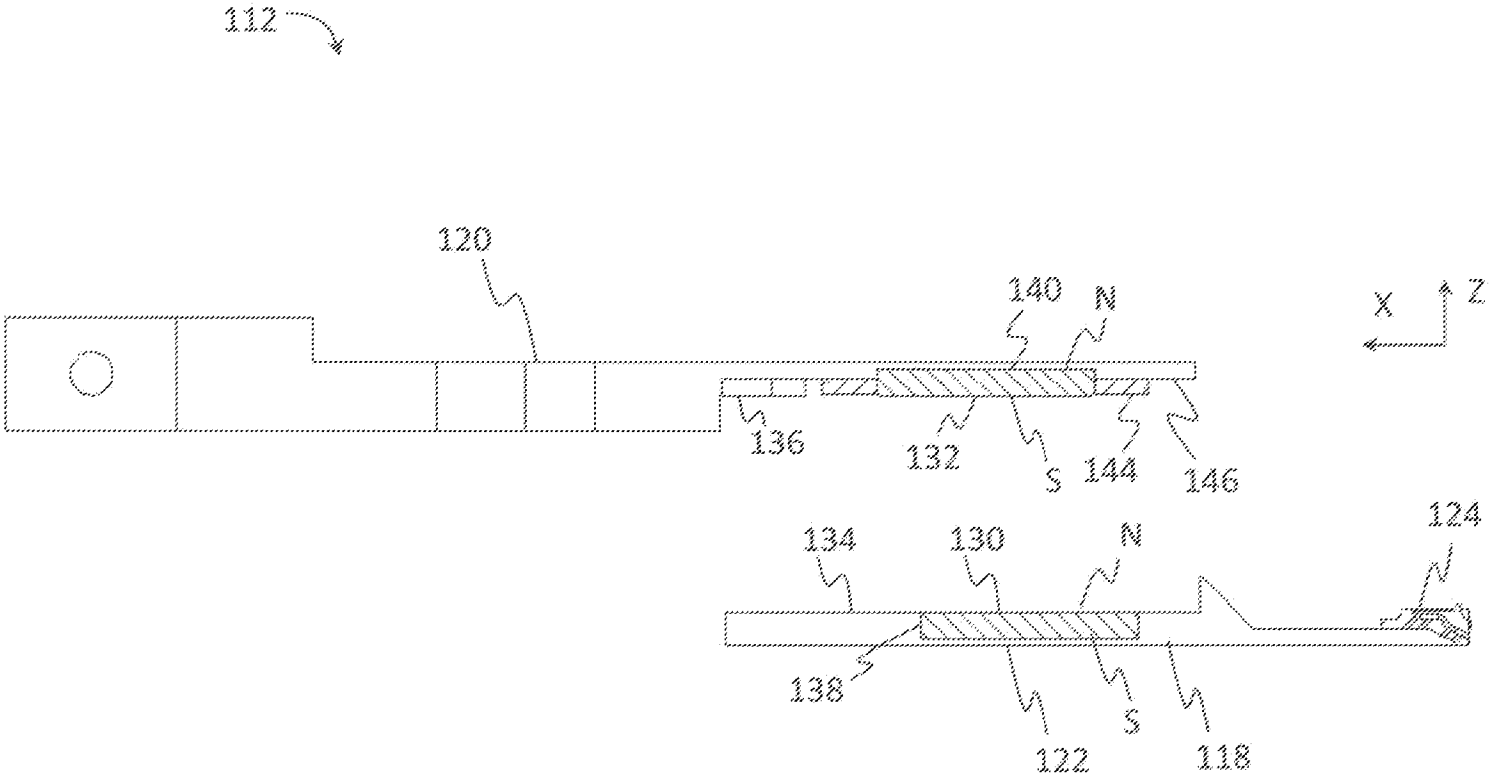
FIG. 6 is an exploded cross sectional side view of first and second portions of the sealing mechanism shown in FIG. 7.
Figure 7:
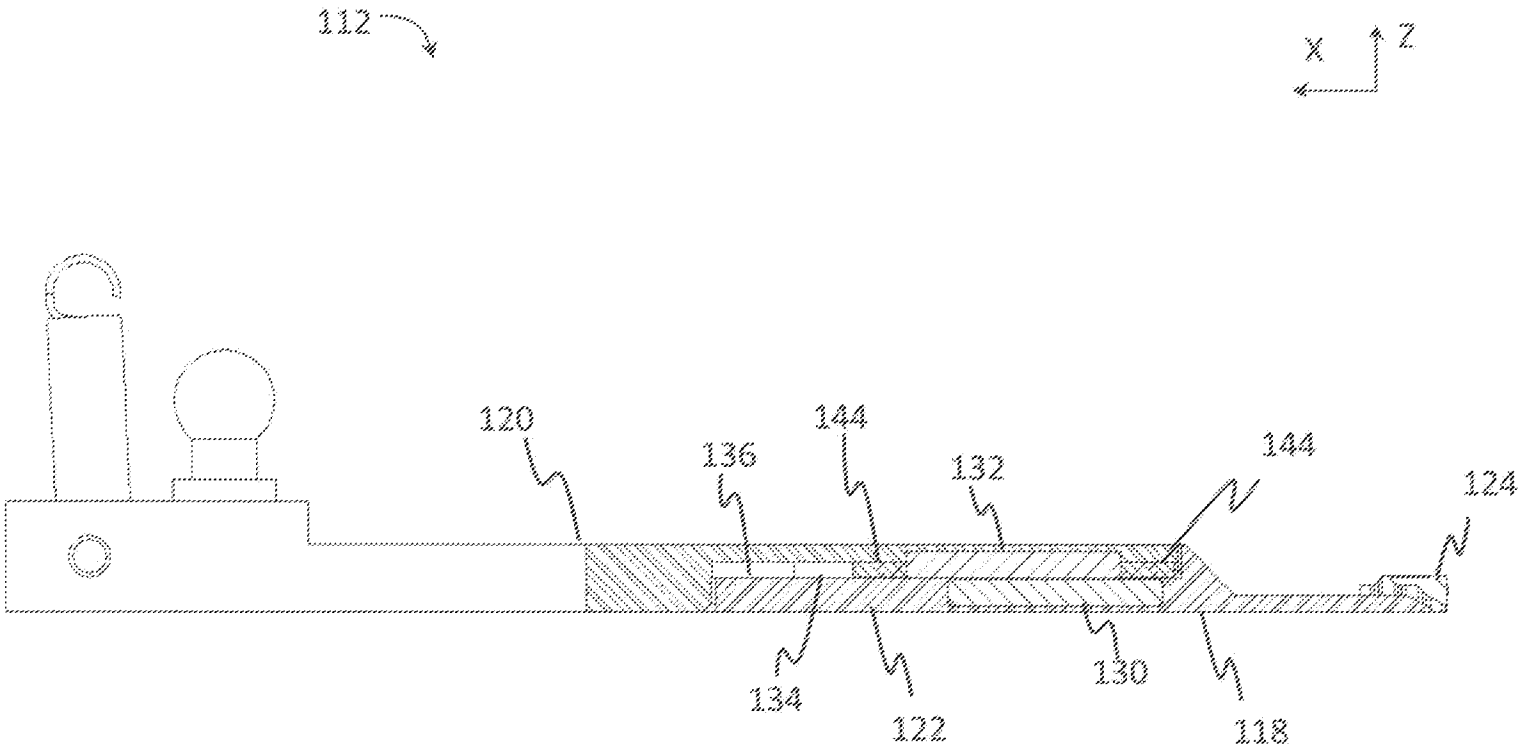
FIG. 7 is a cross sectional side view of first and second portions of the sealing mechanism taken along line 7-7 of FIG. 4.
Figure 9:
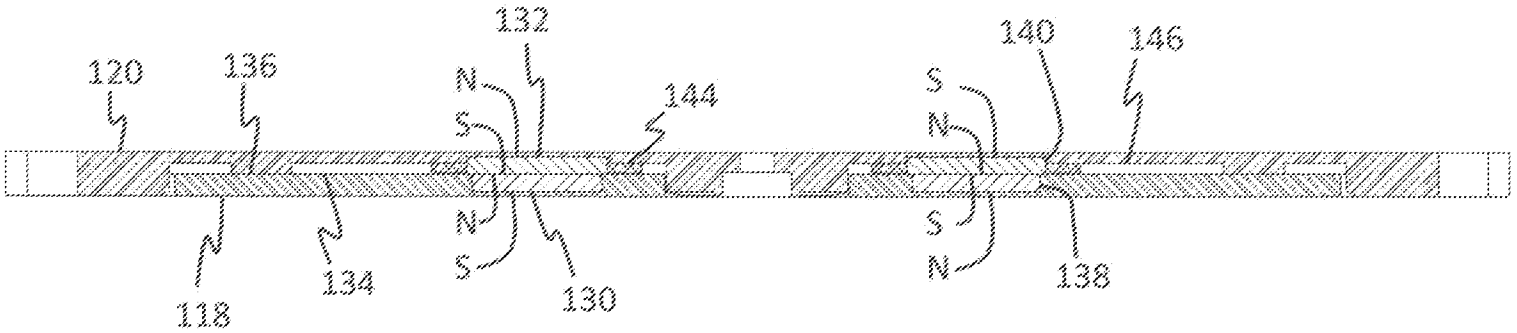
FIG. 9 is a cross sectional side view of first and second portions of the sealing mechanism taken along line 9-9 of FIG. 4.
Figure 10:
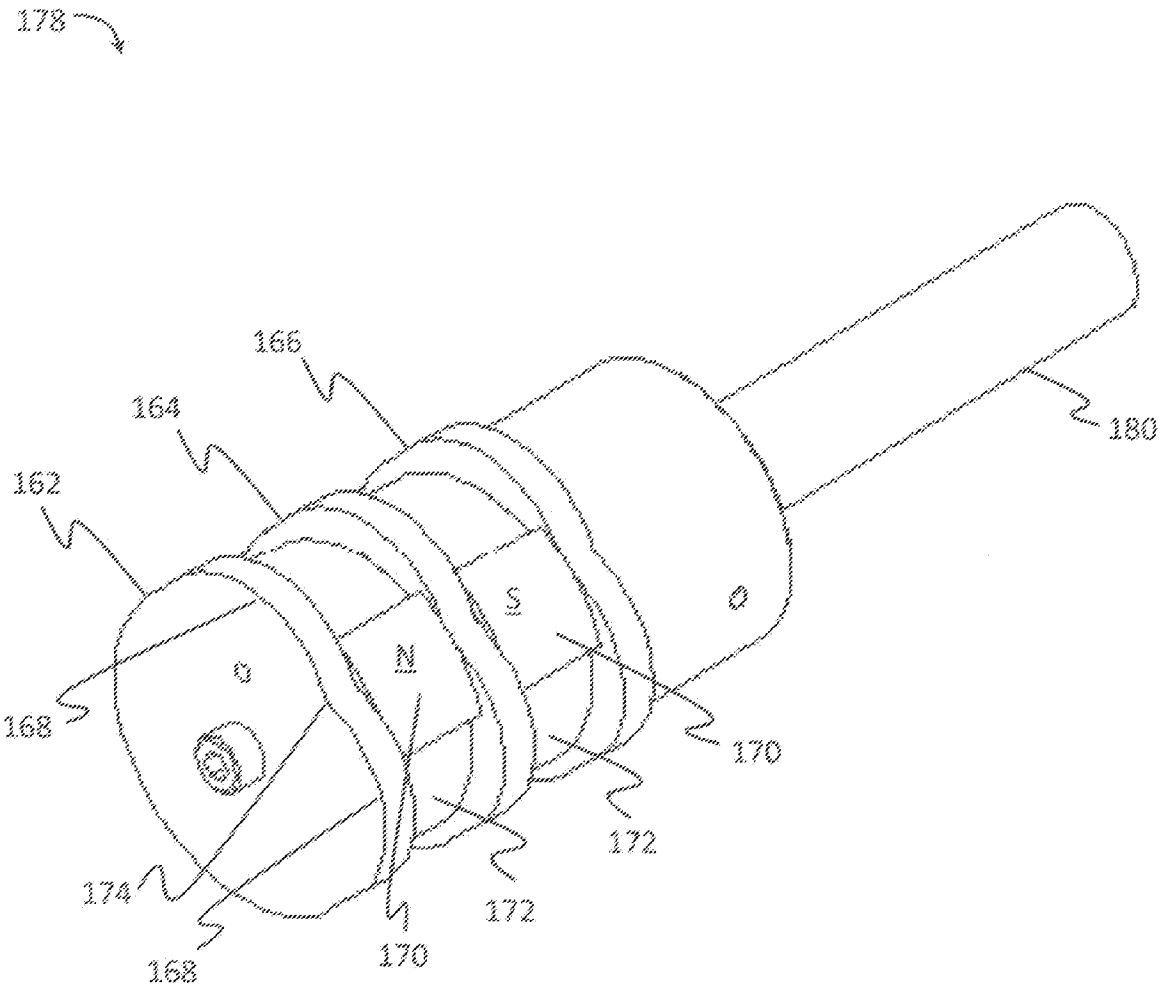
FIG. 10 is a perspective view of a removal tool suitable for removing the removable (second) portion of the sealing mechanism from the first portion of the sealing mechanism.
Figure 11:
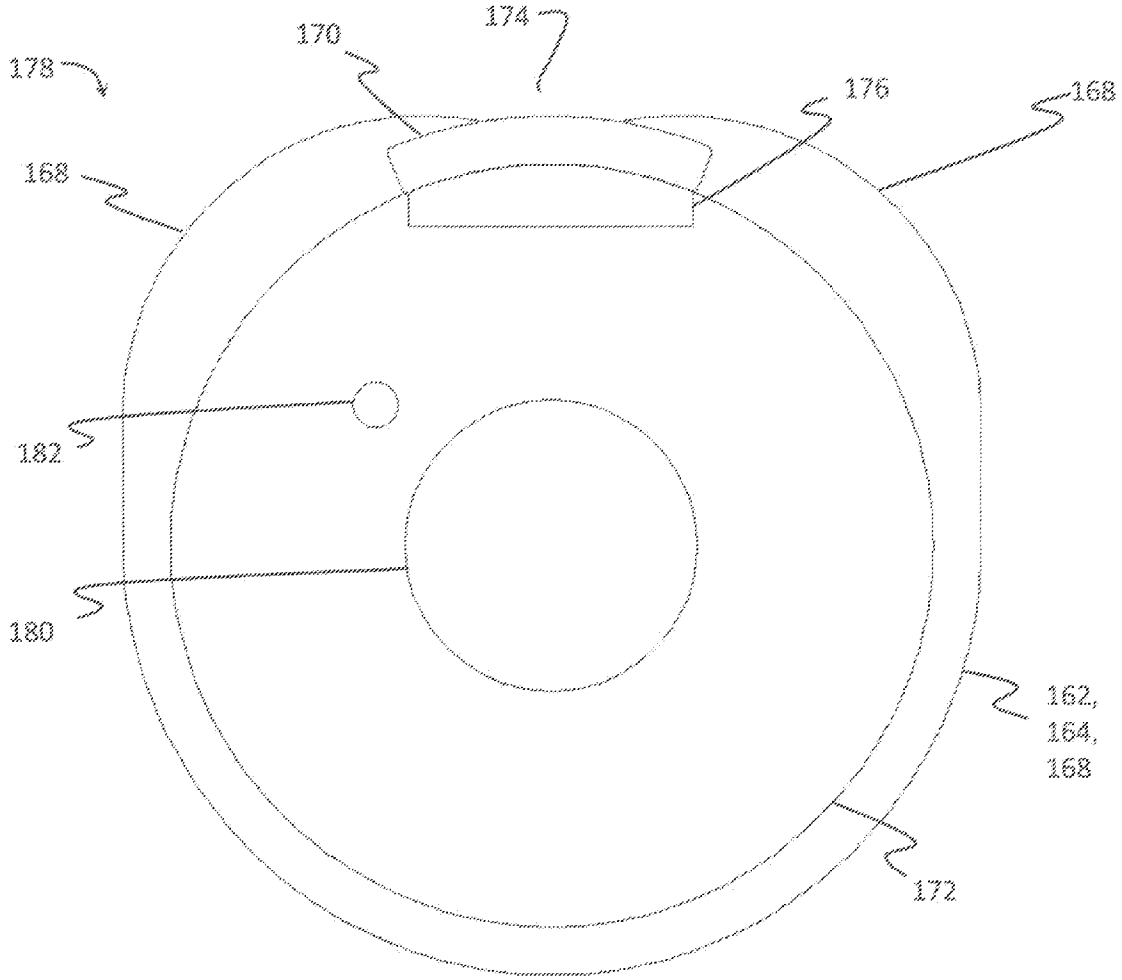
FIG. 11 is a side view of the removal tool shown in FIG. 10.

As shown in FIGS. 6, 7, and 9, the flat upper surface 134 of the removable portion 118 contacts vertical stops 136, also referred to as Z direction stops, on the non-removable portion 120 to define the vertical position of the removable portion 118 relative to the non-removable portion 120; the upper surface of the removable portion and the vertical stop of the non-removable portion being the registration features of the two portions to define a relative position of the two portions along a first axis, the Z axis. The contact of the flat upper surface of the removable portion against the vertical stops of the non-removable portion also defines the rotation of the removable portion about the X and Y axis. The magnets 130 of the removable portion are recessed into pockets 138 in the body 122 of the removable portion, such that the surface of these magnets is recessed below the surface of the surrounding steel regions. The magnets 132 of the non-removable portion are also located in pockets 140 on the non-removable portion, with the face of the magnets recessed relative the plane defined by the vertical stops 136 of the non-removable portion 120 to ensure that the vertical position of the removable portion is defined by the contact of the flat upper surface 134 of the removable portion against the vertical stops 136 of the non-removable portion rather than by contact to the magnets. The pole faces of the magnets of the removable portion are planar and parallel to the planar pole faces of the magnets on the non-removable portion. The attraction of the magnets on the removable portion 118 to the magnets of the non-removable portion 120 provides the force perpendicular to the plane of the magnet faces to hold the upper surface of the removable portion in contact with the vertical stops of the non-removable portion.

Figure 8:
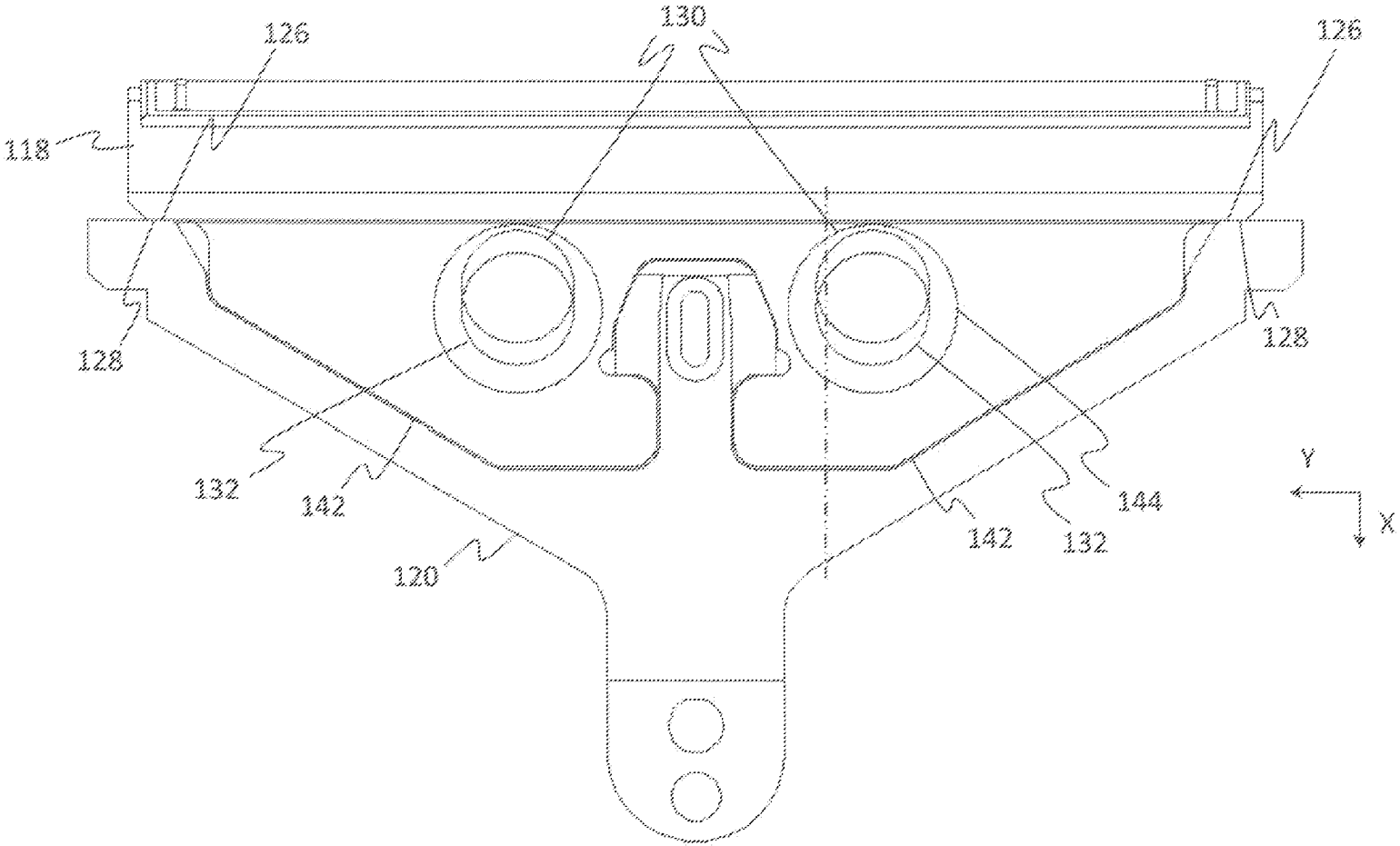
FIG. 8 is a top view of the sealing mechanism shown in FIG. 3.

FIG. 8 shows a top view of the movable sealing mechanism with the magnet features of both the removable portion and non-removable portions shown. Locating features 126 at each end of the body 122 of the removable portion 118 engage the locating features 128 at each end of the non-removable portion 120. These locating features define a relative position of the two portions along a second axis, the X axis, which is perpendicular to the Z axis. The engagement of these locating features locates the removable portion in the X direction and in rotation about the Z axis relative to the non-removable portion. The force to engage these locating features on the removable portion with the corresponding locating features on the non-removable portion is provided by the magnets 130 and 132. As shown, the magnets 130 of the removable portion have been partially offset in the X direction, parallel to the plane of the face of the magnets, relative to the magnets 132 of the non-removable portion. The offset causes a portion of the pole face of the magnets 130 of the removable portion to not be aligned adjacent to the pole face of the magnets 132 of the non-removable portion, and a portion of the pole face of the magnets 132 of the non-removable portion to not be aligned adjacent to the pole face of the magnets 130 of the removable portion. The magnetic fields produced by the offset of the magnets produce an X direction force, parallel to the offset, and parallel to the plane of the magnetic pole faces, on the removable portion 118 to cause the locating features 126 of the removable portion to engage with the corresponding locating features 128 on the non-removable portion. In a preferred embodiment, the pole faces of both magnets in each offset magnet pair have the same size as each other.

The body 122 of the removable portion 118 and the non-removable 120 portion of the sealing mechanism are preferably made of a soft ferromagnetic material such as 17-4 PH stainless steel to enhance the magnetic force securing the removable portion to the non-removable portion. Alternatively, the body 120, the removable portion 118, or both can be made from a non-magnetic material. A soft magnetic material is a material that is easily magnetized and demagnetized. In contrast, permanent magnets are hard magnetic materials. The terms hard and soft magnetic materials don't relate to the mechanical pliability of the material. However, when a soft magnetic material is used for the bodies of the removable and non-removable ports of the movable seal, then it is necessary to provide a recessed area around the magnets of at least one of the removable portion or the non-removable portion. FIGS. 3, 6, and 9 show the face 146 of the non-removable portion 120 as recessed relative to the face of the magnet 130 in the vicinity of the magnets. Without such a recess, some of the magnetic flux from the magnets is shunted through the soft magnetic material adjacent to the magnets instead of being forced to pass directly from one magnet to the adjacent one. This significantly reduces the lateral forces produced by the offset of the magnet pairs. As an alternatively to the configuration shown in FIGS. 3, 6, and 9, the face of the removable portion can include a recess instead of or in addition to the recess around the magnet of the non-removable portion. To prevent an edge of the removable part 118 from being attracted to and contacting the exposed sides of the magnets 132, a ring 144 of aluminum or other non-magnetic material is placed in the recess around the sides of the magnets on the non-removable portion, to provide a non-magnetic surface around magnet. If the bodies of both the removable and non-removable portions of the movable seal are made of a non-magnetic material, then the recess regions around the magnets are not necessary.

In a preferred embodiment shown in FIG. 9, the two portions of the movable seal each have one magnet with an exposed N pole and one magnet with an exposed S pole. As the body of the non-removable portion 120 is made of a soft magnetic material, which has a high permeability, it provides a magnetic path for the magnetic flux between the unexposed north pole of the one magnet to the unexposed south pole of its other magnet. As a result, the soft magnetic material of the non-removable portion helps shield components above the movable seal, such as the air flow duct 74 (FIG. 1), from the magnetic field of the magnets. By providing a magnetic path between the unexposed magnetic poles of the two magnetic, the soft magnetic material of the body also increases the magnetic attraction at the exposed faces of its two magnets. In a similar manner, body of the removable portion being made of a high permeability soft magnetic material, it provides a magnetic path for the magnetic flux between the unexposed poles of its two magnets. As a result it provides some magnetic shielding to components below the movable seal, from the magnetic field of the magnets. It also increases the magnetic attraction at the exposed faces of its two magnets. As a result, by using the magnet poling configuration shown in FIG. 5, the magnetic attraction of the removable portion to the non-removable portion is enhanced when compared to a magnetic poling configuration in which each of the four magnets are poled with their N poles in the same direction. While this embodiment has two magnet pairs, other embodiments can have a single magnet pair, while other embodiments can have more than two magnet pairs.

In this sealing mechanism application, the positioning of the removable portion in the Y direction, parallel to the nozzle array, is not critical. Therefore there is no need for alignment features on the two components to define the position of the removable portion in the Y direction. There is therefore no need to apply a biasing force in the Y direction on the removable portion. The magnets on the removable portion have no offset in the Y direction relative to the magnets on the non-removable portion of the sealing mechanism, and therefore they provide no force in the y-direction. In general it is preferred for the magnet offset to be aligned along the direction in which the vector biasing force is to be applied.

To enable the locating features 126 of the removable portion 118 to engage the locating features 128 of the non-removable portion 120, the removable portion needs to be able to slide relative to the non-removable portion. It is desirable for the contacting surfaces, the vertical stops 136 of the non-removable portion 120 and the upper surface 134 of the removable portion, to be very hard (mechanically) so that the contact forces don't deform these contacting surfaces. It is also desirable for the contacting surfaces to have smooth finishes. In some embodiments, the contacting surfaces are hardened to minimize deformation and are electropolished or electrochemical deburred to produce the desired smooth finishes.

The elastomeric seal 124 of the sealing mechanism 112 needs to be able to moved into contact with the bottom plate 116 of the catcher 42 to close off the outlet opening 44 when the printhead is shut down, and it must retract to open the outlet opening when the printhead is ready for printing (FIG. 1). At times, ink can dry at the contact point between the elastomeric seal 124 and the catcher bottom plate 116, causing the seal to stick to the catcher bottom plate. To ensure that the retraction force applied by the actuator 110 is coupled through the non-removable portion 120 to the removable portion 118 of the eyelid mechanism 112 to retract the removable portion, the non-removable portion includes a raised barb 148; see FIG. 3. The back edge 150 of the barb 148 engages the corresponding edge 152 in an opening 154 in the removable portion to transfer the retraction force from the non-removable portion 120 to the removable portion 118.

The engagement of the barb 148 of the non-removable portion with the corresponding opening 154 in the removable portion necessitates the removal of the removable portion of the sealing mechanism 112 by directly pulling the removable portion away from the non-removable portion in the z-direction. To avoid over extending the springs that hold the removable seal in place and provide the sealing force of the movable seal against the bottom surface of the air duct 74 (FIG. 1), the non-removable portion is limited in downward travel by a screw, not shown, passing through the center slot 156 of the barb 148 that is anchored into another portion of the printhead 30. This screw provides no vertical force on the moveable seal except when the movable seal is being pulled down during the process of removing the removable portion of the seal assembly.

To aid in guiding the removable portion into position when it is being reinstalled, the non-removable portion includes some sloped guiding surfaces which enable the removable portion to slide toward the proper position. These sloped guiding surfaces 156 include the sloped upper surfaces of the barb 148. Contact of the removable portion with these sloped upper surfaces of the barb cause the removable portion to slide back into position. Near the locating features 128 of the non-removable portion 120, there are additional sloped guiding surfaces 160 to slide the contacting removable portion 118 forward and into position.

With the minimal clearance for accessing the sealing mechanism, a removal tool 178 is desirable for removing and reinstalling the removable portion 118 of the sealing mechanism. One such removal tool 178 is shown in FIGS. 10-13. The tool includes three non-magnetic spacers 162, 164, and 166 mounted on common shaft 180. The three spacers are shaped as cams each with two lobes 168 spaced 90 degrees apart, with a valley 174 between the two lobes 168. The lobes of the three spacers are aligned with the corresponding lobes of the other spacers. In a preferred embodiment, the three spacers are made of Delrin®. Partial ring shaped magnets 170 are secured to a non-magnetic core 172 on each side of the central spacer 164. The magnets wrap around a 45 degree arc. One of the magnets 170 has its north pole on the outer surface and the other magnet has its south pole on the outer surface as shown on FIG. 10. The core 172 can be made of non-magnetic materials such as 304 stainless steel, aluminum, or plastics. The midpoints of the arcs of the magnets are aligned with the valley 174 between the lobes 168. A pin 182 passing through holes in the three spacers 162, 164, and 164 and the non-magnetic cores 172 maintains the alignment of the valleys 174 in the spacers and the magnets 170 attached to the non-magnetic cores 172. In one embodiment, the two magnets 170 are secured to magnetic insert 176, either a soft or hard magnetic material, inserted into the non-magnetic core; the magnetic material insert helps to couple the magnetic fields from the two magnets to increase the magnetic holding force of the tool to the removable portion. When the tool is positioned adjacent to the removable portion of the sealing mechanism, with the magnets of the tool facing the removable portion, the magnetic attraction of the tool to the removable portion is stronger than the magnetic attraction of the removable portion to the non-removable portion.

Figure 12:
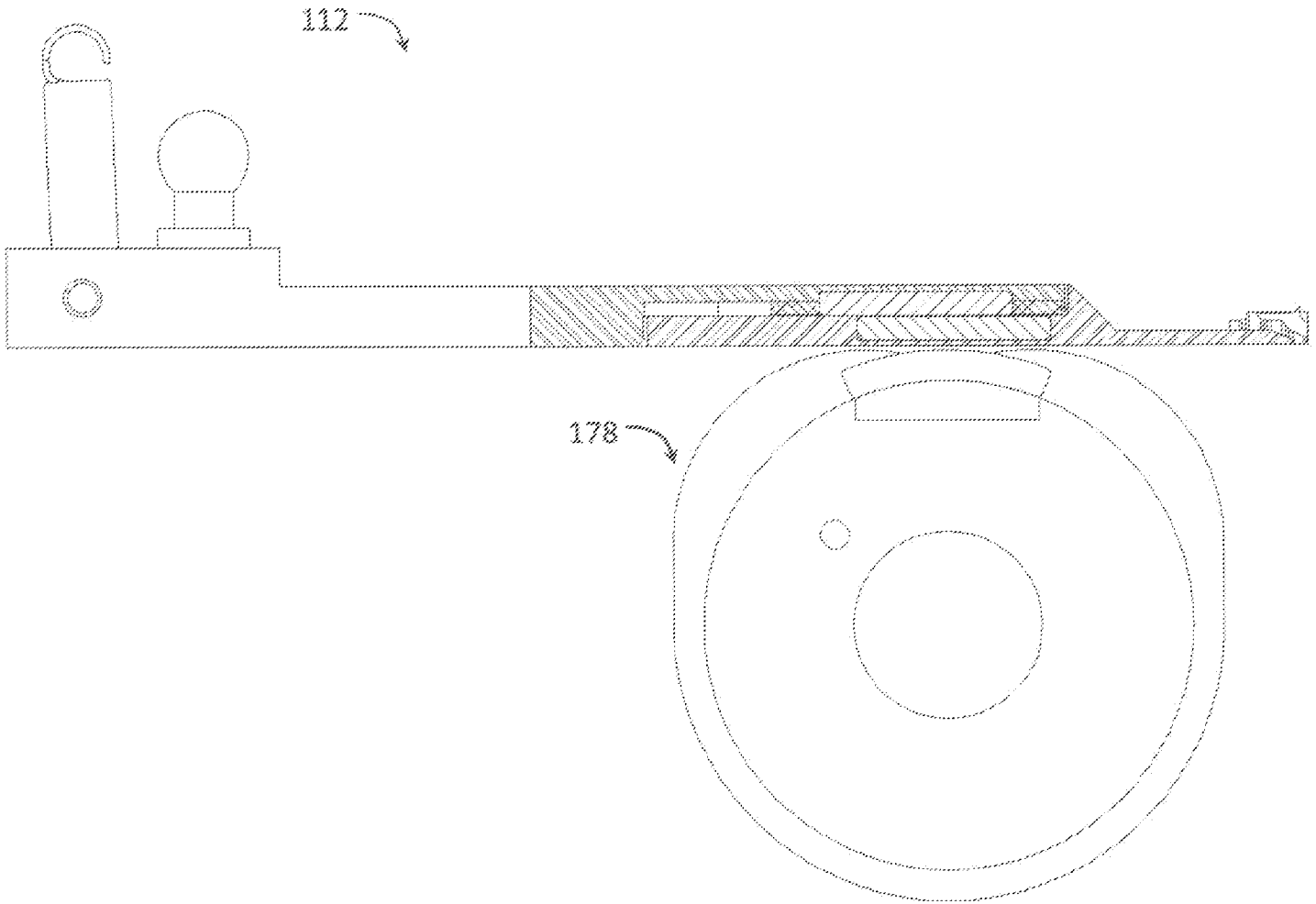
FIGS. 12-14 are partial cross sectional sides views of the sealing mechanism and removal tool illustrating removal and installation of the removable (second) portion of the sealing mechanism.
Figure 13:
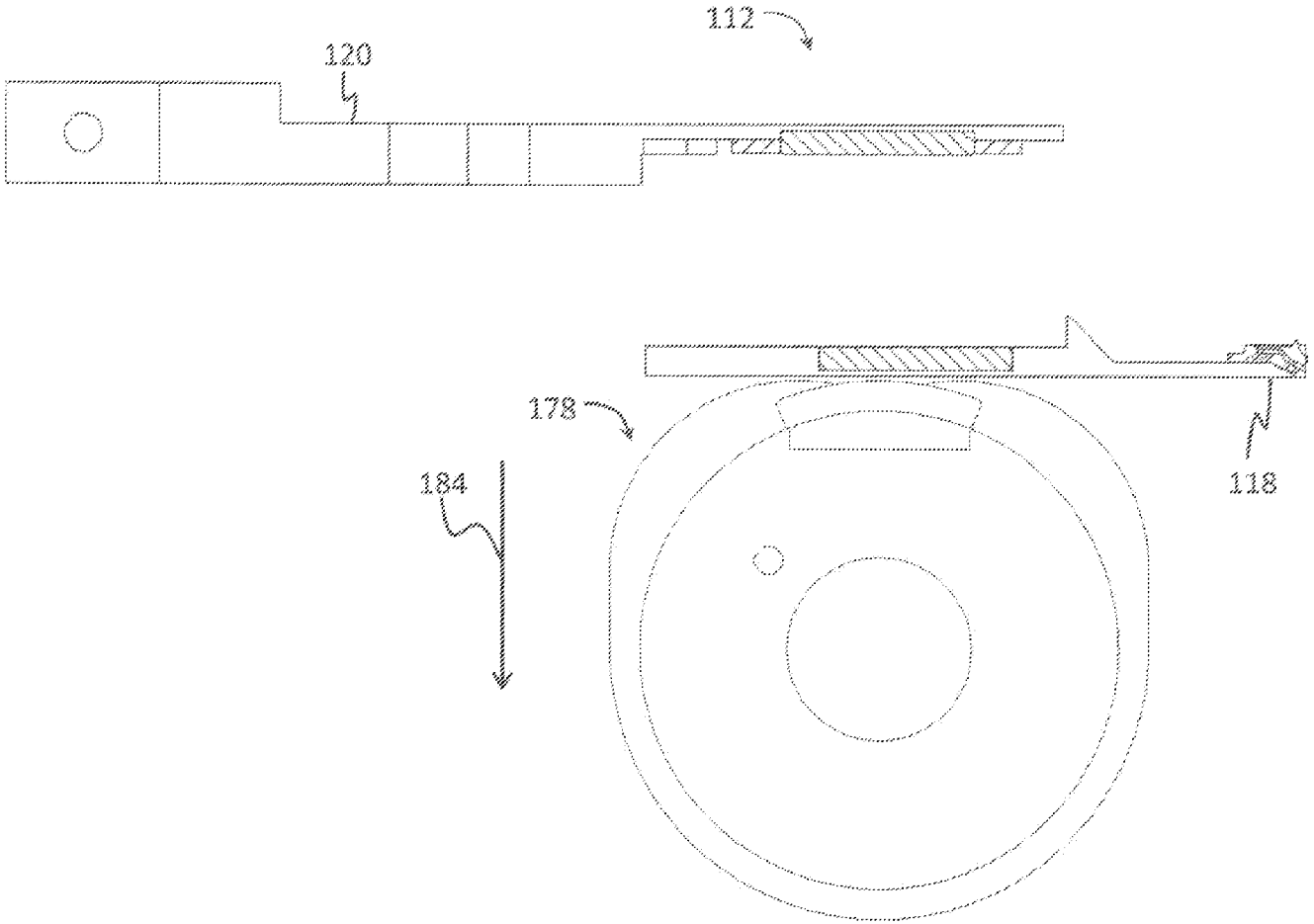

To remove the removable portion of the movable seal, the operator, holding on to the shaft of the removal tool, positions the removal tool 178 under the removable portion 118 with the magnets 170 facing the removable portion 118, and brings the removal tool into contact with the removable portion, as shown in FIG. 12. With the removal tool 178 firmly secured by its magnets 170 to the removal portion of the sealing mechanism 112, a downward force (represented using arrow 184) is applied to the tool. As the magnet force securing the tool to the removable portion is stronger than the magnetic force securing the removable portion of the seal assembly to the non-removable portion, the downward force on the tool causes the removable portion of the seal assembly to break loose from the non-removable portion, as indicated in FIG. 13. The tool with the attached removable portion can then be extracted from under the printhead.

Figure 14:
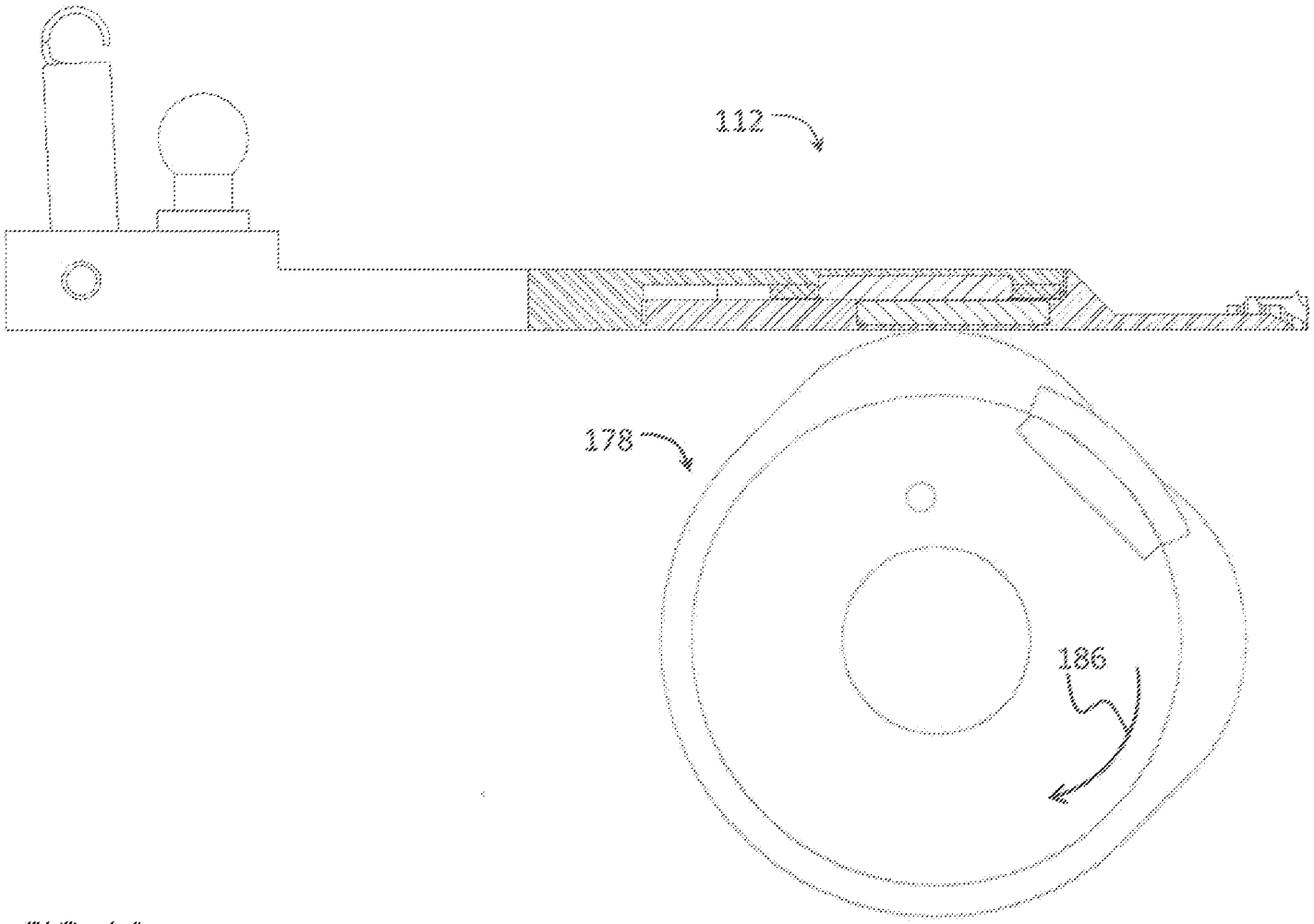

To reinstall the removable portion 118, the removal tool 178 with the attached removable portion is positioned approximately in place under printhead 30 and the removable portion is allowed to magnetically attach to the non-removable portion 120. The guiding surfaces 158 and 160 of the non-removable portion, described earlier, help the removable portion to slide into the proper position, so the installer doesn't have to be precise in positioning the removal tool and the removable portion of the sealing mechanism relative to the non-removable portion. To separate the removal tool 178 from the removable portion 118 of the sealing mechanism, the removal tool is rotated about the axis of the shaft (represented using arrow 186), as shown in FIG. 14. This rotation rolls the contact point of the removal tool 178 with the removable portion 118 up onto one of the lobes 168 of the non-magnetic spacers to increase the spacing of the magnets of the tool away from the removable portion. This weakens the attractive force between the removal tool and the removable portion so that the removal tool can be separated from the removable portion of the sealing assembly.

The invention has been described in detail with particular reference to certain preferred embodiments thereof, but it will be understood that variations and modifications can be effected within the scope of the invention.

PARTS LIST

30 printhead
48 jetting module
49 nozzle plate
42 catcher
44 outlet opening
57 drop streams
72 positive pressure air flow duct
74 lower wall
78 negative pressure air flow duct
86 liquid return channel
110 actuator
112 movable sealing mechanism
114 elastomeric portion
116 bottom plate
118 removable portion
120 non-removable portion
122 body
124 elastomeric seal
126 locating features of the removable portion
128 locating features of the non-removable portion
130 magnet of the removable portion
132 magnet of the non-removable portion
134 upper surface
136 vertical stop
138 pocket of the removable portion
140 pocket of the non-removable portion
142 clearance gap
144 ring
146 face
148 barb
150 edge
152 edge
154 opening
156 slot
158 guiding surface
160 guiding surface
162 spacer
164 spacer
166 spacer
168 lobe
170 magnet
172 non-magnetic core
174 valley
176 magnetic insert
178 removal tool
180 shaft
182 pin
184 downward force arrow
186 rotational force arrow

The invention claimed is:

1. A printhead comprising:

a jetting module that forms drops;

a catcher;

a deflection mechanism that deflects some of the drops toward the catcher; and a moveable sealing mechanism having a first position in contact with the catcher and a second position removed from the catcher that permits drops to travel past the catcher, the moveable sealing mechanism including a first portion that that is fixed to the printhead and translates the sealing mechanism relative to the catcher, and a second portion that is removably fixed to the first portion and cooperates with the catcher to form a seal when the sealing mechanism is in the first position, the first portion of the sealing mechanism including at least one magnet and the second portion of the sealing mechanism including at least one magnet that are positioned relative to each other such that they attract to one another to removably fix the second portion of the sealing mechanism to the first portion of the sealing mechanism, the first portion of the sealing mechanism and the second portion of the sealing mechanism each including registration features that align the first portion and the second portion relative to each other when the registration features engage each other, wherein the at least one magnet of the first portion of the sealing mechanism and the at least one magnet of the second portion of the sealing mechanism are offset relative to each other in a direction to impart a force in that direction that causes the registration features of the first portion of the sealing mechanism and the second portion of the sealing mechanism to engage each other.

2. The printhead of claim 1, further comprising a non-magnetic surface adjacent to the at least one magnet on at least one of the first portion and second portion of the sealing mechanism to facilitate the force in the direction that causes the registration features of the first portion of the sealing mechanism and the second portion of the sealing mechanism to engage each other.

3. The printhead of claim 1, one of the first portion of the sealing mechanism and the second portion of the sealing mechanism including guiding features that permit the first portion of the sealing mechanism and the second portion of the sealing mechanism to cooperate with each other to guide the positioning of the first portion of the sealing mechanism and the second portion of the sealing mechanism relative to each other.

4. The printhead of claim 1, wherein the registration features include a first set of registration features that define a relative position of the first portion and the second portion along a first axis and a second set of registration features that define a relative position of the first portion and the second portion along a second axis that is perpendicular to the first axis.

5. The printhead of claim 1, wherein the relative offset position of the at least one magnet of the first portion of the sealing mechanism and the at least one magnet of the second portion of the sealing mechanism provides a force in the offset direction that causes the registration features of the first set to engage each other and causes the registration features of the second set to engage each other.

6. The printhead of claim 1, the first portion of the sealing mechanism and the second portion of the sealing mechanism each including registration features that align the first portion and the second portion relative to each other when the registration features engage each other.

7. The printhead of claim 1, wherein the at least one magnet of the first portion of the sealing mechanism includes a face and the at least one magnet of the second portion of the sealing mechanism includes a face that has the same size as the adjacent face of the corresponding magnet of the first portion.

8. The printhead of claim 1, the first portion of the sealing mechanism and the second portion of the sealing mechanism each including features that cooperate with each other to transfer a retraction force from the first portion to the second portion when the moveable sealing mechanism moves from the first position to the second position.

* * * * *